US008191180B2

(12) United States Patent
Berry

(10) Patent No.: US 8,191,180 B2
(45) Date of Patent: Jun. 5, 2012

(54) APPARATUS FOR PREVENTING HEAD OR NECK INJURY USING MAGNETIC ASSISTANCE

(76) Inventor: Bret Berry, Tallahassee, FL (US)

( * ) Notice: Subject to any disclaimer, the term of this patent is extended or adjusted under 35 U.S.C. 154(b) by 289 days.

(21) Appl. No.: 12/762,529

(22) Filed: Apr. 19, 2010

(65) Prior Publication Data

US 2010/0263110 A1 Oct. 21, 2010

Related U.S. Application Data

(60) Provisional application No. 61/171,107, filed on Apr. 21, 2009.

(51) Int. Cl.
*A63B 71/10* (2006.01)

(52) U.S. Cl. ..... 2/468; 2/425; 602/18

(58) Field of Classification Search ..... 335/216, 335/306; 2/411, 416, 425, 468; 602/17, 602/18

See application file for complete search history.

(56) References Cited

U.S. PATENT DOCUMENTS

| | | | |
|---|---|---|---|
| 3,604,027 | A | 9/1971 | Konno |
| 3,645,480 | A | 2/1972 | Forman |
| 5,103,513 | A | 4/1992 | King |
| 5,462,518 | A | 10/1995 | Hatley et al. |
| 5,502,901 | A | 4/1996 | Brown |
| 5,800,490 | A | 9/1998 | Patz et al. |
| 5,823,982 | A | 10/1998 | Park |
| 7,051,374 | B1 | 5/2006 | Grilliot et al. |
| 7,155,747 | B2 | 1/2007 | Baker |
| 7,500,484 | B2 | 3/2009 | Nelson et al. |
| 2008/0313791 | A1 | 12/2008 | Nagely |

FOREIGN PATENT DOCUMENTS

WO 2009042863 A1 4/2009

OTHER PUBLICATIONS

International Preliminary Report on Patentability for corresponding PCT application No. PCT/US2010/031557, Oct. 25, 2011.

International Search Report and Written Opinion for corresponding PCT application No. PCT/US2010/031557, Jun. 28, 2010.

*Primary Examiner* — Ramon Barrera

(74) *Attorney, Agent, or Firm* — Matthew B. Dernier, Esq.; Gibson & Dernier LLP

(57) ABSTRACT

A helmet and shoulder pad combination is provided with an improved helmet support and restrictor to minimize rearward hyperextension and whiplash-type head movement as well as axial compression.

20 Claims, 5 Drawing Sheets

APPARATUS FOR PREVENTING HEAD OR NECK INJURY USING MAGNETIC ASSISTANCE

CROSS REFERENCE TO RELATED APPLICATIONS

This application claims the benefit of U.S. Provisional Patent Application No. 61/171,107, filed Apr. 21, 2009, the entire disclosure of which is hereby incorporated by reference.

FIELD OF THE INVENTION

The present invention relates to support equipment adapted for use by athletes, such as football players, motor sports participants, such auto racing, and/or military, such as fighter pilots, in conjunction with shoulder pads and helmets for opposing hyperextension, whiplash head movement, and/or axial compressive forces.

BACKGROUND OF THE INVENTION

Athletes participating in severe contact sports, such as American football, are subject to exposure to hyperextension, whiplash-type head movement, and axial cervical compressive forces. Players at positions such as interior lineman, for example, are subjected to physical contact on virtually every play which can force the player's head rapidly backward to create a whiplash effect which can result in serious and disabling injury. Moreover, persons involved in activities such as high speed vehicle test piloting and race car driving can also be exposed to hyperextension or whiplash-type injuries caused by high rates of acceleration and impact forces.

Several types of helmet restrictors have been developed for athletes participating in severe contact sports such as football wherein the player's helmet, for example, is interconnected with a set of shoulder pads, or other support structure worn on the shoulders, by a brace which restricts backward movement of the helmet.

However, these devices also severely limit rotational or side-to-side movement of the head, which restriction is usually unwanted by the player and may interfere with play execution as a result of the limitations on head movement.

Yet another type of conventional protective device used by football athletes, in particular, comprises a cushion-like collar which is attached to the shoulder pads and substantially encircles the neck between the helmet and the pads. Again, that type of collar is uncomfortable and limits head movement in directions which the player may wish to make. Such types of collars also tend to sometimes exert a choking effect on the wearer when severely deflected or purposely or inadvertently grabbed by another player during play action. Moreover, some conventional restraint devices have also been constructed in a manner which does not adequately take advantage of the load reacting and distributing capability of the largest structure worn by a football player, namely the shoulder pad assembly. The limitations of conventional devices noted herein, as well as others recognizable to those skilled in the art, have been substantially overcome by the protective helmet support and movement restrictor of the present invention.

SUMMARY OF THE INVENTION

In all of the above-mentioned activities, it is desirable to minimize the chance of hyperextension or whiplash injury while also minimizing unwanted restriction to movement of the head. In other words, in the case of football athletes, protection against rearward hyperextension or whiplash-type injury is highly desired, but the player also does not want to have head movement restricted such as by attachment of any device to the helmet or to protective gear such as shoulder pads which will restrict turning of the head, side-to-side movement of the head, or even forward movement of the head when desired. At the same time, however, it is desirable to provide protective means which is capable of restricting rearward movement of the head and particularly rapid or whiplash-type movement. Moreover, the protective device should be able to distribute the forces between the protective device and the helmet and between the protective device and structure attached to the body to minimize discomfort or prevent injury to the wearer of the protective device at some other point.

Still further, the operating environment of protective devices, particularly for football players, is such that it is desirable to be able to replace at least a part of the protective device which comes in contact with the helmet after repeated exposure to perspiration, rain, snow and mud, for example. There is a continuing interest in providing improvements for use by persons requiring head protection, which will make the play of the game safer without unduly restricting normal head movement.

One or more embodiments of the present invention provide a unique helmet support and movement restrictor particularly adapted to be used in conjunction with shoulder pads for football players, motor sports drivers, pilots and the like.

In accordance with one or more aspects of the present invention, a helmet and shoulder pads with a magnetic movement restrictor is provided which limits movement of the helmet in a rearward whiplash direction as well as an axial compressive direction without restricting desired side-to-side or turning movement of the helmet. The arrangement of the helmet magnets and shoulder pad magnets is such as to avoid contact with the wearer's head and neck during normal activity while instead engaging the magnets and being capable of substantial cushioning action and rearward movement restriction in the event of backward hyperextension or whiplash-type movement or axial compression of the helmet.

In accordance with one or more further aspects of the present invention, a magnetic helmet support and movement restrictor is provided which is particularly adapted to be used in conjunction with a set of football shoulder pads wherein a cooperative force distributing and reacting effect between the shoulder pads, body arches or chest and back plates and the helmet movement restrictor is obtained.

In accordance with one or more further aspects of the present invention, a magnetic helmet support for attachment to a helmet and magnetic movement restrictor for attachment to shoulder pads are provided which may be easily retrofitted to existing shoulder pads and helmets or may be supplied with new shoulder pads when manufactured. The helmet support and movement restrictor advantageously utilizes a uniquely configured set of magnets for supporting a set of opposing magnets on the helmet. The opposing magnets create an invisible cushion between the helmet and shoulder pads which does not restrict side-to-side movement or turning.

In accordance with one or more embodiments of the present invention, an apparatus includes: a helmet sized and shaped to receive and protect a user's head from injury; a shoulder pad assembly sized and shaped to receive and protect the user's shoulders; a first housing coupled to the helmet and including at least one first magnet; and a second housing coupled to the shoulder pad assembly and including at least one second magnet. The first and second magnets are oriented within the respective first and second housings such that, when the helmet and the shoulder pad assembly are worn by the user, there is resistance to movement of the first and second housings toward one another.

Preferably, each of the first and second magnets includes north and south poles. The first and second magnets are preferably oriented within the respective first and second housings such that either the respective north poles thereof or the respective south poles thereof are directed toward one another to produce a magnetic opposing force, which produces the resistance to movement.

The helmet may include at least one peripheral edge at least partially circumscribing an opening for receiving the user's head. The first housing may be located at a lower, rear portion of the peripheral edge of the helmet. Alternatively or additionally, the shoulder pad assembly may include at least one peripheral edge at least partially circumscribing an opening through which the user's neck extends. The second housing may be located at a rear portion of the peripheral edge of the shoulder pad assembly.

The first and second magnets may be are oriented within the respective first and second housings, and the first and second housings may be oriented on the helmet and shoulder pad assembly, respectively, such that, when the helmet and the shoulder pad assembly are worn by the user, the opposing force and resistance to movement restrict rearward hypertension and whiplash movement of the user's head and neck. Additionally or alternatively, such orientations may produce the opposing force and resistance to movement in order to restrict axial compression of the user's neck.

The first housing may include a plurality of magnets constituting the at least one first magnet and forming a first array of magnets. Additionally or alternatively, the second housing may include a plurality of magnets constituting the at least one second magnet and forming a second array of magnets. The magnets of the first and/or second arrays of magnets include north and south poles, and the first and second arrays of magnets may be oriented within the respective first and second housings such that either the respective north poles of the respective pluralities of magnets, or the respective south poles of the respective pluralities of magnets, are directed toward one another to produce a magnetic opposing force, which produces the resistance to movement.

The first array of magnets may be oriented in a semicircular pattern when viewed along respective polar axes of the plurality of magnets thereof. Additionally or alternatively, the second array of magnets may be oriented in a semicircular pattern when viewed along respective polar axes of the plurality of magnets thereof.

The at least one first magnet may be implemented using one or more of a permanent magnet, an electro-magnet, a superconductor magnet, and a semiconductor magnet. Additionally or alternatively, the at least one second magnet may be implemented using one or more of a permanent magnet, an electro-magnet, a superconductor magnet, and a semiconductor magnet.

The apparatus may further include a power source disposed within the helmet, where the at least one first magnet is implemented using at least one electro-magnet, and the power source within the helmet is coupled to, and provides operating power to, the at least one electro-magnet. Additionally or alternatively, the apparatus may further include a power source disposed within the shoulder pad assembly, where the at least one second magnet is implemented using at least one electro-magnet, and the power source within the shoulder pad assembly is coupled to, and provides operating power to, the at least one electro-magnet.

The apparatus may further include a cooling source disposed within the helmet, where the at least one first magnet is implemented using at least one a superconductor magnet, semiconductor magnet and/or electro-magnet, and the cooling source within the helmet is thermally coupled to, and cools, the at least one a superconductor magnet, semiconductor magnet and/or electro-magnet. The cooling mechanism may include at least one of a mechanical heat sink element and a Peltier cooling mechanism.

Additionally or alternatively, the apparatus may further include a cooling source disposed within the shoulder pad assembly, where the at least one second magnet is implemented using at least one a superconductor magnet, semiconductor magnet and/or electro-magnet, and the cooling source within the shoulder pad assembly is thermally coupled to, and cools, the at least one a superconductor magnet, semiconductor magnet and/or electro-magnet. Again, the cooling mechanism may include at least one of a mechanical heat sink element and a Peltier cooling mechanism.

In accordance with one or more further embodiments of the present invention, an apparatus may include: a helmet sized and shaped to receive and protect a user's head from injury, the helmet including at least one peripheral edge at least partially circumscribing an opening for receiving the user's head; a shoulder pad assembly sized and shaped to receive and protect the user's shoulders, the shoulder pad assembly including at least one peripheral edge at least partially circumscribing an opening through which the user's neck extends; a first housing coupled to the helmet and located at a lower, rear portion of the peripheral edge of the helmet, the first housing including a plurality of magnets forming a first array of magnets; and a second housing coupled to the shoulder pad assembly and located at a rear portion of the peripheral edge of the shoulder pad assembly, the second housing including a plurality of magnets forming a second array of magnets.

Each of the magnets of the first and second arrays of magnets include north and south poles. The first and second arrays of magnets may be oriented within the respective first and second housings, such that either the respective north poles of the respective pluralities of magnets, or the respective south poles of the respective pluralities of magnets, are directed toward one another to produce a magnetic opposing force, which produces resistance to movement of the first and second housings toward one another when the helmet and the shoulder pad assembly are worn by the user.

The first array of magnets may be oriented in a semicircular pattern when viewed along respective polar axes of the plurality of magnets thereof. Additionally or alternatively, the second array of magnets may be oriented in a semicircular pattern when viewed along respective polar axes of the plurality of magnets thereof.

The first array of magnets may include one or more of a permanent magnet, an electro-magnet, a superconductor magnet, and a semiconductor magnet; and/or the second array of magnets may include one or more of a permanent magnet, an electro-magnet, a superconductor magnet, and a semiconductor magnet.

A first power source may be disposed within the helmet, the first array of magnets including at least one electro-magnet, superconductor magnet, and/or semiconductor magnet, and the first power source being coupled to, and providing operating power to, the at least one electro-magnet, superconductor magnet, and/or semiconductor magnet; and/or a second power source may be disposed within the shoulder pad assembly, the second array of magnets including at least one electro-magnet, superconductor magnet, and/or semiconductor magnet, and the second power source being coupled to, and providing operating power to, the at least one electro-magnet, superconductor magnet, and/or semiconductor magnet.

A cooling source may be disposed within the helmet and thermally coupled to, and cooling, the at least one semiconductor magnet, a superconductor magnet, and/or electro-magnet of the first array of magnets; and/or a cooling source may be disposed within the shoulder pad assembly and thermally coupled to, and cooling, the at least one semiconductor magnet, a superconductor magnet, and/or electro-magnet of the second array of magnets.

Those skilled in the art will further appreciate the above-mentioned features and advantages of the invention together with other superior aspects thereof upon reading the detailed description which follows in conjunction with the drawings.

BRIEF DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE PREFERRED EMBODIMENTS

Figure 1:
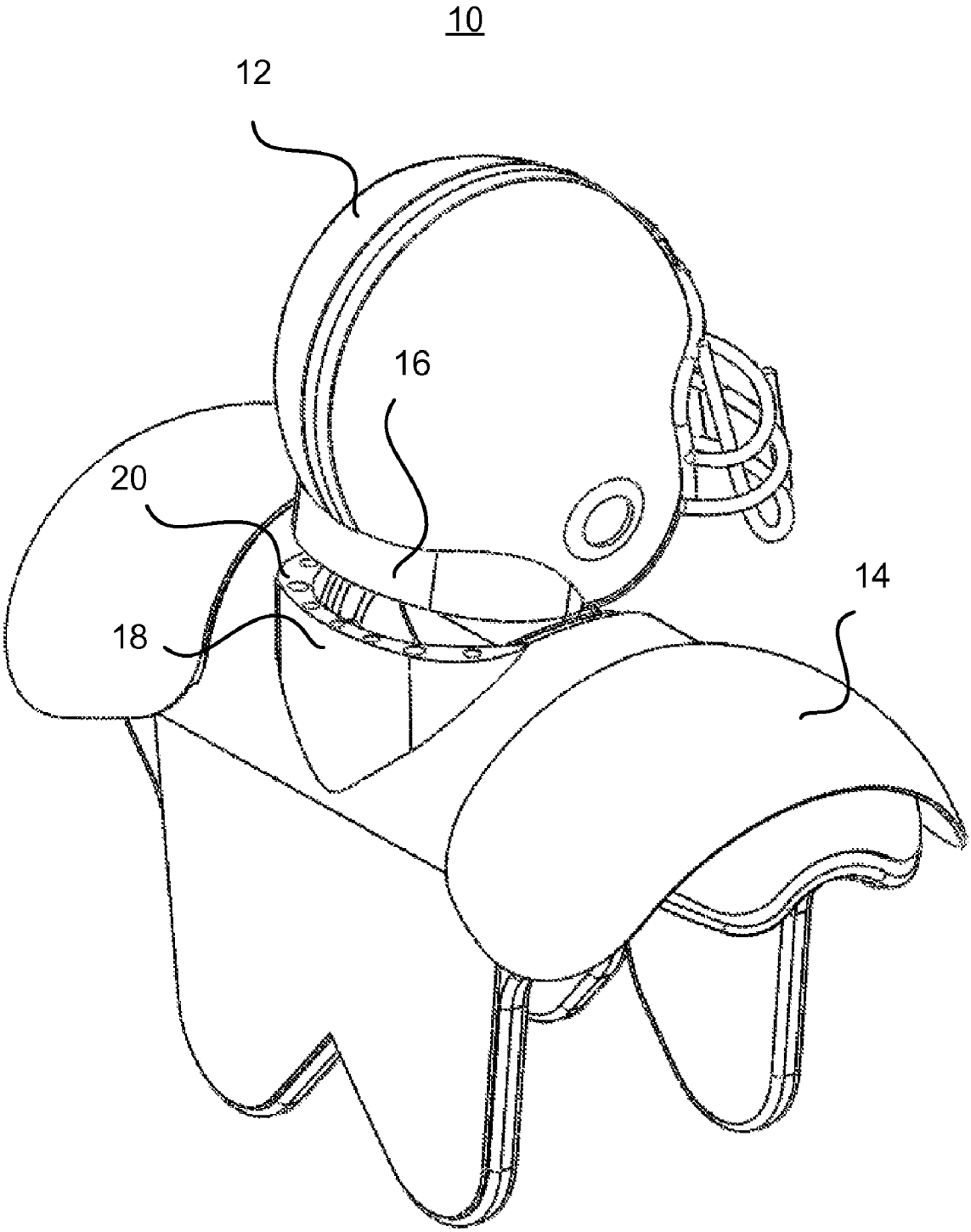
FIG. 1 is a back perspective view of the improved helmet and shoulder pads with magnetic movement restrictor in accordance with one or more embodiments of the present invention.

In the description which follows, like elements are marked throughout the specification and drawing with the same reference numerals, respectively. The drawing figures are not necessarily to scale in the interest of clarity and conciseness.

Figure 2:
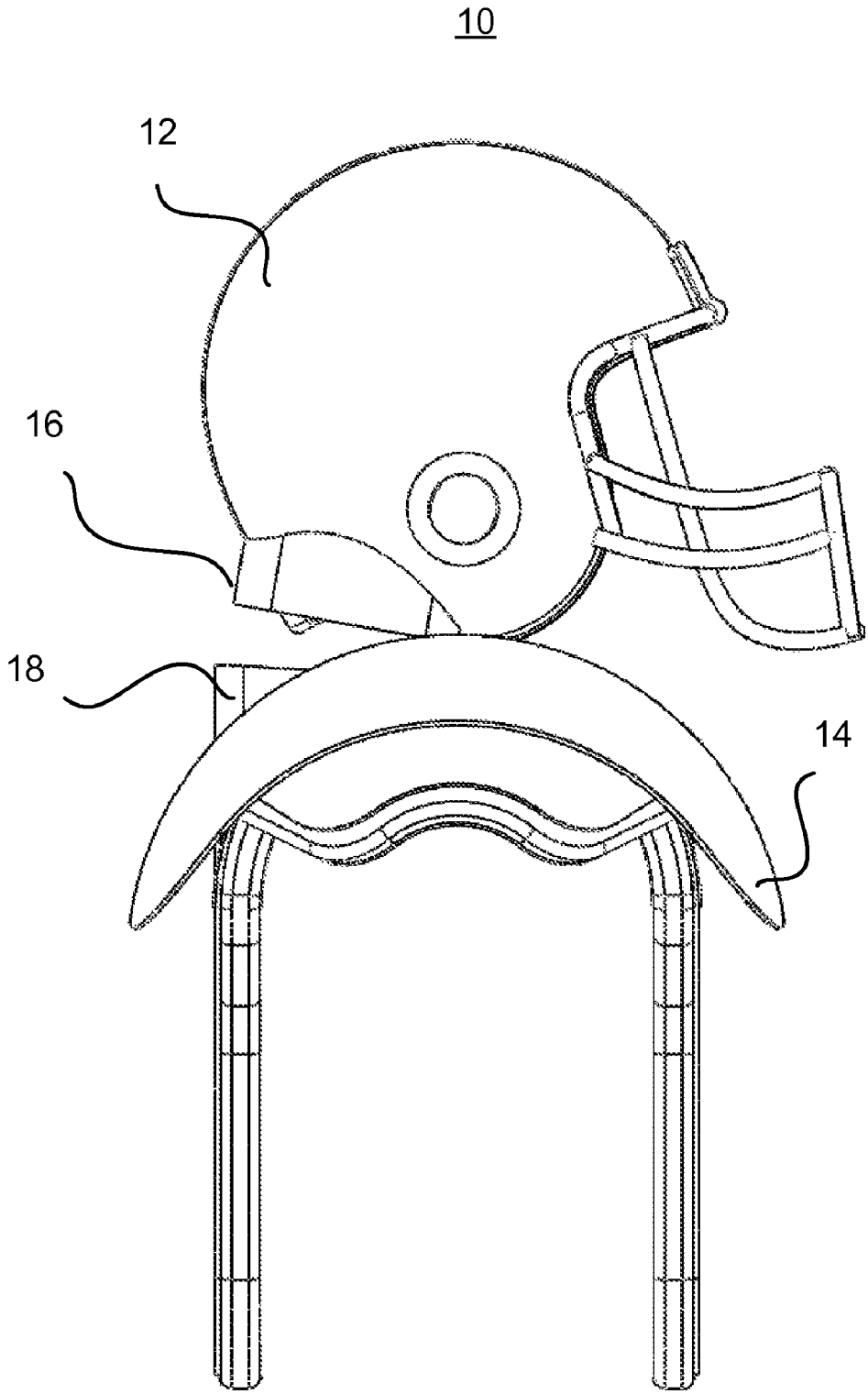
FIG. 2 is a side view of the improved helmet and shoulder pads with magnetic movement restrictor.
Figure 3:
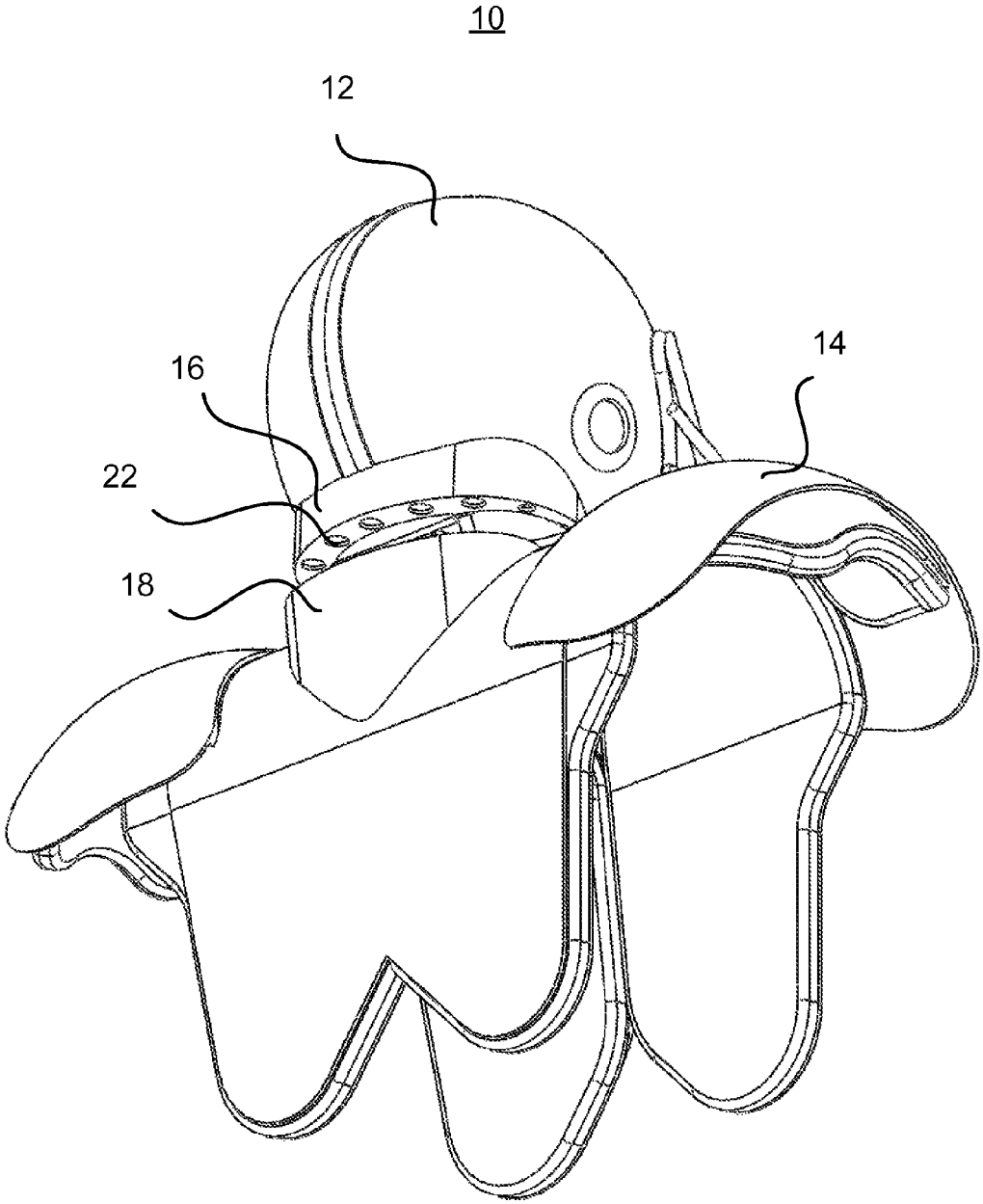
FIG. 3 is a another back perspective view of the improved helmet and shoulder pads with magnetic movement restrictor.
Figure 4:
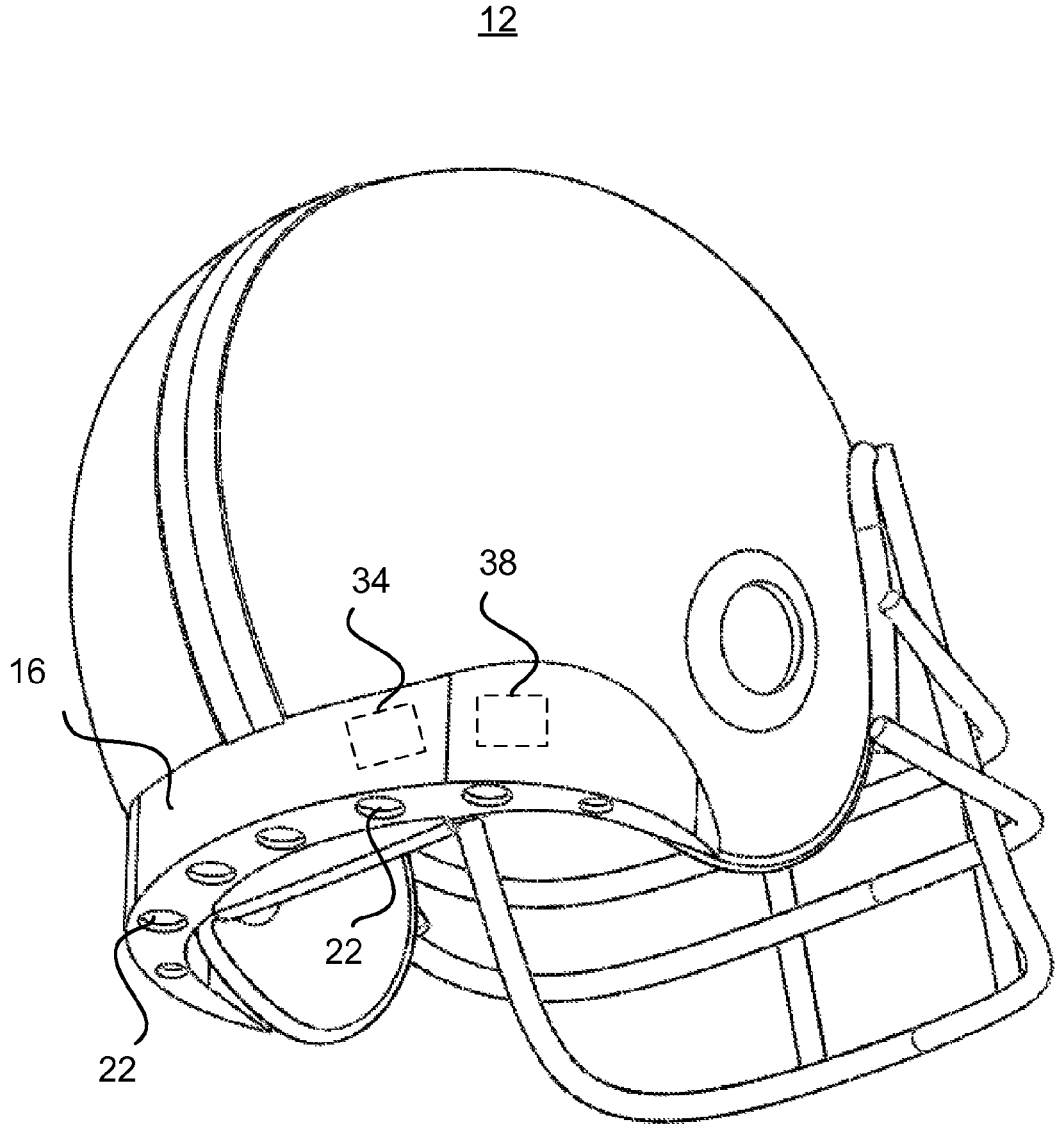
FIG. 4 is a back perspective view of the improved helmet with magnetic movement restrictor.
Figure 5:
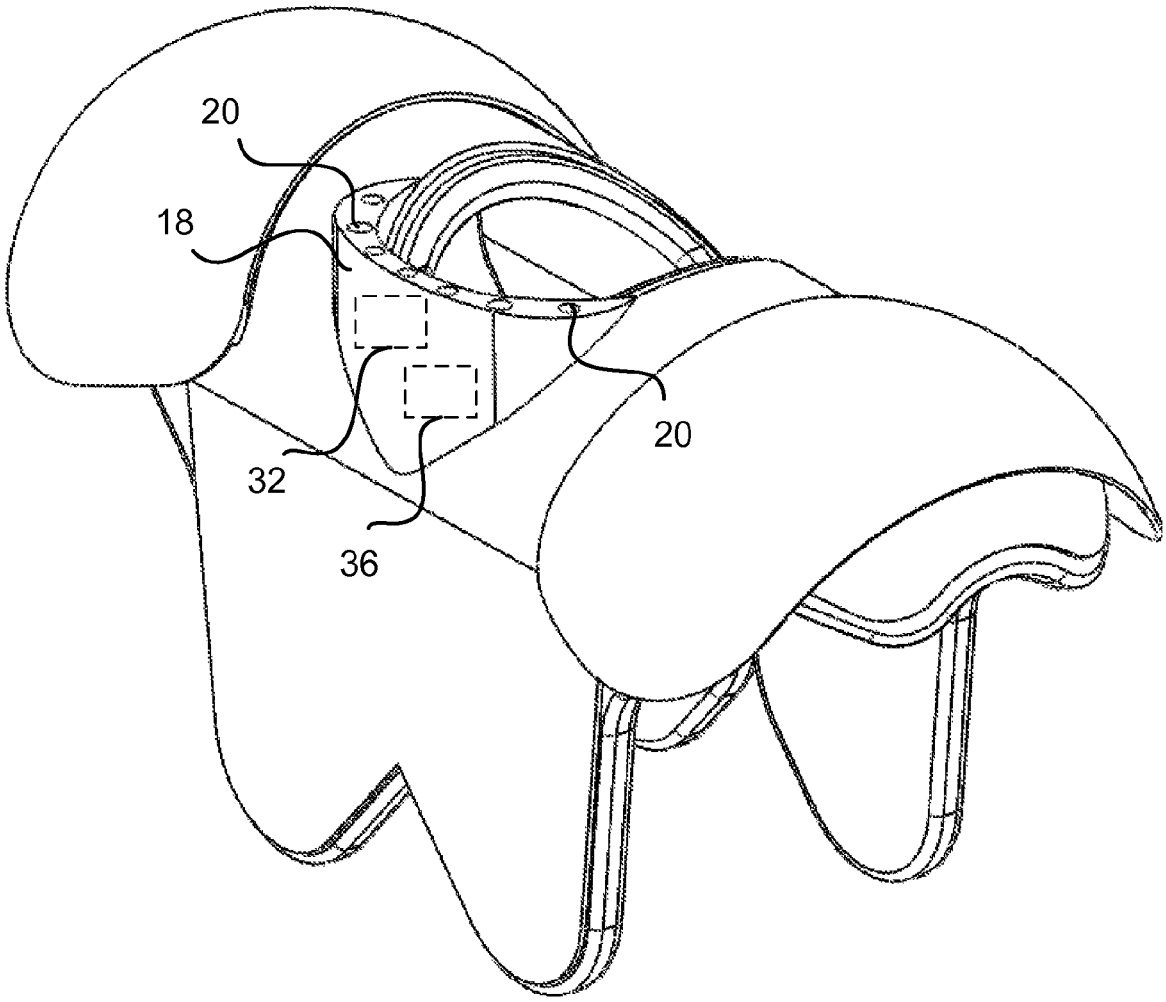
FIG. 5 is a back perspective view of the improved shoulder pads with magnetic movement restrictor.

As depicted in FIGS. 1-5, the magnetic movement restrictor 10 is comprised of a helmet 12 and shoulder pads 14. As shown, the helmet 12 and shoulder pads 14 are designed for football, however, the movement restrictor could as easily be incorporated for use in motor sports or aviation, or any other application where whiplash or axial compressive forces cause injury. Attached to the rear, lower, exterior portion of the helmet 12 is a magnetic housing 16. The magnetic housing 16 can be retrofitted to any existing helmet 12, or can be supplied with a new helmet. The housing 16 itself can be constructed of a plastic similar to that of the helmet 12. Likewise, the shoulder pads 14 have a magnetic housing 18 attached to the rear, upper, exterior portion. The magnetic housing 18 can be retrofitted to any existing set of shoulder pads 14, or can be supplied with a new set of shoulder pads. The housing 18 can be made of plastic similar to the shoulder pads 14.

Within the housing 18 is an array of magnets 20. In one or more configurations, each of these magnets 20 may be oriented in the same manner, with similar poles facing upward towards the helmet 12. Within the helmet housing 16 is an array of magnets 22. In one or more configurations, each of these magnets 22 may be oriented in the same manner, with similar poles facing downward towards the shoulder pads 14.

The magnets 22 on the helmet 12 may each have similar poles, say North for sake of example, facing towards the magnets 20 on the shoulder pads 14. Similarly, the magnets 20 on the shoulder pads 14 may each have the same pole, North in this case, facing the magnets 22 of the helmet 12. The respective sets of magnets 20, 22, with like poles facing each other, create an opposing force which resists movement of the helmet 12 towards the shoulder pads 14. Thus, the magnets 20 of the housing 16 and the magnets 22 of the housing 16 provide a cushioning effect for the user.

In alternative embodiments, there may be a single magnet 20 in the housing 16 and a single magnet in the housing 18, each of which is sized and shaped to achieve the opposed configuration and cushioning effect.

The magnets 20, 22 may be permanent magnets, electro-magnets, and/or super-conductor magnets. In the case that the magnets 20, 22 are electromagnets, the power sources 32, 34 therefor may be located in the respective housings 18, 16. Likewise, in the case that the magnets 20, 22 are superconductors, the cooling sources 36, 38 therefor may be located in the respective housings 18, 16.

The construction and use of the magnetic movement restrictor 10, in conjunction with the helmet 12 and shoulder pad assembly 14, is believed to be readily understandable to those of ordinary skill in the art from the foregoing description. The restrictor 10 can be easily included in the helmet 12 or shoulder pad assembly 14 at the time of manufacture or can be retrofitted to existing shoulder pad assemblies, if desired. The materials used in fabricating the support and movement restrictor 10 have been described in some detail, and the fabrication of the component parts of the restrictor are believed to be within the capability of those skilled in the art.

Other combinations of elements contemplated herein in accordance with various embodiments include:

A helmet support and movement restrictor for use in conjunction with a shoulder pad assembly comprising: a helmet with at least one magnet and a set of shoulder pads with at least one magnet.

A helmet support and movement restrictor as set forth above, where the magnet on the helmet creates an opposing force to the shoulder pads magnet.

A helmet support and movement restrictor as set forth above, where the magnets restrict rearward hypertension and whiplash movement of the user's head and/or neck.

A helmet support and movement restrictor as set forth above, where the magnets restrict axial compression of the wearer's neck.

A helmet support and movement restrictor set forth above, where the helmet magnet is a permanent magnet.

A helmet support and movement restrictor set forth above, where the helmet magnet is an electro-magnet.

A helmet support and movement restrictor set forth above, where the helmet magnet has an internal power source within the helmet.

A helmet support and movement restrictor set forth above, where the helmet magnet is a semiconductor magnet.

A helmet support and movement restrictor set forth above, where the helmet magnet has an internal cooling source within the helmet.

A helmet support and movement restrictor set forth above, where the shoulder pad magnet is a permanent magnet.

A helmet support and movement restrictor set forth above, where the shoulder pad magnet is an electro-magnet.

A helmet support and movement restrictor set forth above, where the shoulder pad magnet has an internal power source within the shoulder pads.

A helmet support and movement restrictor set forth above, where the shoulder pad magnet is a semiconductor magnet.

A helmet support and movement restrictor set forth above, where the shoulder pad magnet has an internal cooling source within the shoulder pads.

A helmet support and movement restrictor set forth above, where the helmet has more than one magnet.

A helmet support and movement restrictor set forth above, where at least one magnet on the helmet is a permanent magnet.

A helmet support and movement restrictor set forth above, where at least one magnet on the helmet is an electro-magnet.

A helmet support and movement restrictor set forth above, where the helmet magnet has an internal power source within the helmet.

A helmet support and movement restrictor set forth above, where at least one magnet on the helmet is a semiconductor magnet.

A helmet support and movement restrictor set forth above, where the helmet magnet has an internal cooling source within the helmet.

A helmet support and movement restrictor set forth above, where the shoulder pads have more than one magnet.

A helmet support and movement restrictor set forth above, where at least one magnet on the shoulder pads is a permanent magnet.

A helmet support and movement restrictor set forth above, where at least one magnet on the shoulder pads is an electro-magnet.

A helmet support and movement restrictor set forth above, where the shoulder pads magnet has an internal power source within the shoulder pads.

A helmet support and movement restrictor set forth above, where at least one magnet on the shoulder pads is a semiconductor magnet.

A helmet support and movement restrictor set forth above, where the shoulder pads magnet has an internal cooling source within the helmet.

The magnetic helmet support and magnetic movement restrictor of the embodiments of the present invention provides several advantages for use in conjunction with shoulder pads.

The configuration of the magnetic helmet support and magnetic movement restrictor avoids contact with the wearer during normal head movement, does not restrict turning or sideways head movement, does not attach to a helmet in such a way as to impose unwanted loads on other parts of the body when opposing hyperextension or whiplash movement, may be easily retrofitted to existing shoulder pad assemblies or easily attached to new shoulder pad assemblies during manufacture, and is itself relatively easy and economical to manufacture.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An apparatus, comprising:

a helmet sized and shaped to receive and protect a user's head from injury;

a shoulder pad assembly sized and shaped to receive and protect the user's shoulders;

a first housing coupled to the helmet and including at least one first magnet; and a second housing coupled to the shoulder pad assembly and including at least one second magnet, wherein the first and second magnets are oriented within the respective first and second housings such that, when the helmet and the shoulder pad assembly are worn by the user, there is resistance to movement of the first and second housings toward one another.

2. The apparatus of claim 1, wherein:

each of the first and second magnets include north and south poles; and the first and second magnets are oriented within the respective first and second housings such that either the respective north poles thereof or the respective south poles thereof are directed toward one another to produce a magnetic opposing force, which produces the resistance to movement.

3. The apparatus of claim 2, wherein:

the helmet includes at least one peripheral edge at least partially circumscribing an opening for receiving the user's head, and the first housing is located at a lower, rear portion of the peripheral edge of the helmet; and the shoulder pad assembly includes at least one peripheral edge at least partially circumscribing an opening through which the user's neck extends, and the second housing is located at a rear portion of the peripheral edge of the shoulder pad assembly.

4. The apparatus of claim 3, wherein the first and second magnets are oriented within the respective first and second housings, and the first and second housings are oriented on the helmet and shoulder pad assembly, respectively, such that, when the helmet and the shoulder pad assembly are worn by the user, the opposing force and resistance to movement restrict rearward hypertension and whiplash movement of the user's head and neck.

5. The apparatus of claim 3, wherein the first and second magnets are oriented within the respective first and second housings, and the first and second housings are oriented on the helmet and shoulder pad assembly, respectively, such that, when the helmet and the shoulder pad assembly are worn by the user, the opposing force and resistance to movement restrict axial compression of the user's neck.

6. The apparatus of claim 1, wherein at least one of:

the first housing includes a plurality of magnets constituting the at least one first magnet and forming a first array of magnets; and the second housing includes a plurality of magnets constituting the at least one second magnet and forming a second array of magnets.

7. The apparatus of claim 6, wherein:

each of the magnets of the first and second arrays of magnets include north and south poles; and the first and second arrays of magnets are oriented within the respective first and second housings such that either the respective north poles of the respective pluralities of magnets, or the respective south poles of the respective pluralities of magnets, are directed toward one another to produce a magnetic opposing force, which produces the resistance to movement.

8. The apparatus of claim 6, wherein at least one of:

the first array of magnets is oriented in a semi-circular pattern when viewed along respective polar axes of the plurality of magnets thereof; and the second array of magnets is oriented in a semi-circular pattern when viewed along respective polar axes of the plurality of magnets thereof.

9. The apparatus of claim 1, wherein at least one of:

the at least one first magnet is implemented using one or more of a permanent magnet, an electro-magnet, a superconductor magnet, and a semiconductor magnet; and the at least one second magnet is implemented using one or more of a permanent magnet, an electro-magnet, a superconductor magnet, and a semiconductor magnet.

10. The apparatus of claim 1, further comprising:

a power source disposed within the helmet, wherein the at least one first magnet is implemented using at least one electro-magnet, and the power source within the helmet is coupled to, and provides operating power to, the at least one electro-magnet.

11. The apparatus of claim 1, further comprising:

a power source disposed within the shoulder pad assembly, wherein the at least one second magnet is implemented using at least one electro-magnet, and the power source within the shoulder pad assembly is coupled to, and provides operating power to, the at least one electro-magnet.

12. The apparatus of claim 1, further comprising:

a cooling source disposed within the helmet, wherein the at least one first magnet is implemented using at least one a superconductor magnet, semiconductor magnet and/or electro-magnet, and the cooling source within the helmet is thermally coupled to, and cools, the at least one a superconductor magnet, semiconductor magnet and/or electro-magnet.

13. The apparatus of claim 12, wherein the cooling mechanism includes at least one of a mechanical heat sink element and a Peltier cooling mechanism.

14. The apparatus of claim 1, further comprising:

a cooling source disposed within the shoulder pad assembly, wherein the at least one second magnet is implemented using at least one a superconductor magnet, semiconductor magnet and/or electro-magnet, and the cooling source within the shoulder pad assembly is thermally coupled to, and cools, the at least one a superconductor magnet, semiconductor magnet and/or electro-magnet.

15. The apparatus of claim 14, wherein the cooling mechanism includes at least one of a mechanical heat sink element and a Peltier cooling mechanism.

16. The apparatus of claim 1, wherein at least one of:

the first array of magnets includes one or more of a permanent magnet, an electro-magnet, a superconductor magnet, and a semiconductor magnet; and the second array of magnets includes one or more of a permanent magnet, an electro-magnet, a superconductor magnet, and a semiconductor magnet.

17. The apparatus of claim 1, further comprising:

a first power source disposed within the helmet, the first array of magnets including at least one electro-magnet, superconductor magnet, and/or semiconductor magnet, and the first power source being coupled to, and providing operating power to, the at least one electro-magnet, superconductor magnet, and/or semiconductor magnet; and a second power source disposed within the shoulder pad assembly, the second array of magnets including at least one electro-magnet, superconductor magnet, and/or semiconductor magnet, and the second power source being coupled to, and providing operating power to, the at least one electro-magnet, superconductor magnet, and/or semiconductor magnet.

18. The apparatus of claim 17, further comprising at least one of:

a cooling source disposed within the helmet and thermally coupled to, and cooling, the at least one semiconductor magnet, a superconductor magnet, and/or electro-magnet of the first array of magnets; and a cooling source disposed within the shoulder pad assembly and thermally coupled to, and cooling, the at least one semiconductor magnet, a superconductor magnet, and/or electro-magnet of the second array of magnets.

19. An apparatus, comprising:

a helmet sized and shaped to receive and protect a user's head from injury, the helmet including at least one peripheral edge at least partially circumscribing an opening for receiving the user's head;

a shoulder pad assembly sized and shaped to receive and protect the user's shoulders, the shoulder pad assembly including at least one peripheral edge at least partially circumscribing an opening through which the user's neck extends;

a first housing coupled to the helmet and located at a lower, rear portion of the peripheral edge of the helmet, the first housing including a plurality of magnets forming a first array of magnets; and a second housing coupled to the shoulder pad assembly and located at a rear portion of the peripheral edge of the shoulder pad assembly, the second housing including a plurality of magnets forming a second array of magnets, wherein each of the magnets of the first and second arrays of magnets include north and south poles, and the first and second arrays of magnets are oriented within the respective first and second housings, such that either the respective north poles of the respective pluralities of magnets, or the respective south poles of the respective pluralities of magnets, are directed toward one another to produce a magnetic opposing force, which produces resistance to movement of the first and second housings toward one another when the helmet and the shoulder pad assembly are worn by the user.

20. The apparatus of claim 19, wherein at least one of:

the first array of magnets is oriented in a semi-circular pattern when viewed along respective polar axes of the plurality of magnets thereof; and the second array of magnets is oriented in a semi-circular pattern when viewed along respective polar axes of the plurality of magnets thereof.

* * * * *